US007917995B2

(12) United States Patent
Salice

(10) Patent No.: US 7,917,995 B2
(45) Date of Patent: Apr. 5, 2011

(54) FURNITURE HINGE

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 381 days.

(21) Appl. No.: 12/096,818

(22) PCT Filed: Dec. 14, 2006

(86) PCT No.: PCT/EP2006/069723

§ 371 (c)(1),
(2), (4) Date: Jun. 10, 2008

(87) PCT Pub. No.: WO2007/068740

PCT Pub. Date: Jun. 21, 2007

(65) Prior Publication Data

US 2008/0276426 A1 Nov. 13, 2008

(30) Foreign Application Priority Data

Dec. 15, 2005 (IT) ..... RM20050166 U

(51) Int. Cl.
*E05F 1/08* (2006.01)

(52) U.S. Cl. ..... 16/288; 16/319; 16/337; 16/286; 16/54

(58) Field of Classification Search ..... 16/288, 16/319, 337, 341, 342, 352, 366, 370, 49, 16/50, 51, 54, 55, 82, 286, 287, 56, 294, 16/387, 262, DIG. 21; 188/268, 271, 290, 188/291, 296, 322.5, 281, 282.5, 282.8, 282.9
See application file for complete search history.

(56) References Cited

U.S. PATENT DOCUMENTS

| | | | | |
|---|---|---|---|---|
| 2,638,619 | A * | 5/1953 | Kearney | 16/82 |
| 5,022,117 | A * | 6/1991 | Lautenschlager et al. | 16/288 |
| 5,373,609 | A * | 12/1994 | Ferrari et al. | 16/370 |
| 6,859,979 | B2 * | 3/2005 | Egger et al. | 16/286 |
| 7,003,851 | B2 * | 2/2006 | Salice | 16/288 |
| 7,127,778 | B2 * | 10/2006 | Salice | 16/288 |
| 7,328,484 | B2 * | 2/2008 | Salice | 16/288 |
| 2004/0103499 | A1 * | 6/2004 | Egger et al. | 16/242 |
| 2007/0136990 | A1 * | 6/2007 | Salice | 16/282 |

FOREIGN PATENT DOCUMENTS

| | | | |
|---|---|---|---|
| DE | 3840245 | A1 * | 5/1990 |
| DE | 10121977 | | 11/2002 |
| DE | 10211294 | | 9/2003 |
| GB | 2245311 | A * | 1/1992 |
| JP | 63231029 | A * | 9/1988 |
| JP | 05071266 | A * | 3/1993 |

* cited by examiner

*Primary Examiner* — Victor Batson
*Assistant Examiner* — Jeffrey O'Brien
(74) *Attorney, Agent, or Firm* — Gifford, Krass, Sprinkle, Anderson & Citkowski, P.C.

(57) ABSTRACT

Furniture hinge with alternative damping and/or braking device with respect to those existing and able to guarantee a better functional efficiency during closing and opening operation of the doors, or other parts of furniture, even after long periods of inactivity of the same device. The better efficiency of such hinge is also obtained by increasing the friction surfaces with a viscous means present in suitable areas of the hinge and by allowing the regulation of the angular velocity trend of a circular shaped element, for example a disk, that acts as a braking element in contact with the viscous means.

16 Claims, 4 Drawing Sheets

FURNITURE HINGE

TECHNICAL FIELD

The present invention relates to a furniture hinge, in particular to a hinge with spring for doors, or in general for furniture parts suitable to be moved, provided with a damping device that acts during the opening and/or closing of the doors.

BACKGROUND ART

Furniture provided with doors or wings to close compartments and that open by pivoting around a horizontal or vertical axis use various types of hinge. One type that is very widely used today is that one in which the hinges for supporting the doors in a closed position are not visible from outside the furniture when the door is closed.

Hinges of this type are today commonly used in the furniture industry because they have a series of advantages that have determined their extensive use on the market.

Some embodiments of known hinges are provided with springs of various types to produce a return force during closing or a pushing force during opening of the doors to which they are fitted. This allows very precise closing or opening of the doors.

Nonetheless, damping and/or braking devices of the door movement, caused by the elastic reaction of the spring, are desirable in these hinges. The object of these devices is above all to prevent noise caused during closing operations by doors banging shut against the body of the piece of furniture.

There are currently various known damping and braking devices integrated in furniture hinges. One of these devices is described in the patent DE10121977.

This comprises a slider, brought into motion directly or indirectly by one of the hinge rockers, which has at least one sliding surface along a fixed surface of the hinge. A highly viscous grease is inserted between the surfaces. In the preferred embodiment the movable slider is disposed on the cup or box element of the hinge and the fixed surface is that of the outer base of said cup.

However, state of the art damping devices present some drawbacks. In particular, during the operation thereof, it has been observed that the first closing movement of the door or wing, after a certain period of inactivity, is not decelerated in a satisfactory way. A correct device operation therefore only takes place during the subsequent closing movements of the door.

This drawback is due to a minimal dissociation of the molecules constituting the high viscosity grease during the inactivity period of the device, a dissociation that disappears as soon as the molecules are moved in relation to one another following said first closing movement, thus amalgamating once more and recovering their cohesion force.

The need is therefore felt to produce a new damping device able to overcome the aforesaid drawback.

SUMMARY OF THE INVENTION

The main object of the present invention is to produce a furniture hinge provided with an alternative damping and/or braking device with respect to those already existing, guaranteeing improved efficiency during closing and/or opening operations of the doors or other parts of piece of furniture parts, also during the first door movement after a certain period of device inactivity.

A further object is to make the device simpler, keeping the dimensions of standard hinges constant.

The present invention, therefore, proposes to resolve the problems discussed above by producing a furniture hinge that comprises a first member for fixing to a piece of furniture, a second member for fixing to a door of a piece of furniture, comprising a box, said first member being suitable to move with a pivoting motion around a first articulation pin with said box, a connection element for connecting said first member to damping means for damping said pivoting motion, said damping means comprising a damping moving element immersed in a viscous means or structure, the hinge being characterized by the fact that said damping moving element comprises a substantially flat disk, provided on a first face with a closed flat figure shaped groove, and by the fact that there is provided on said connection element at least one tappet element suitable to engage said closed flat figure shaped groove and converting the pivoting motion of the first member in a rotation motion of said disk around the center thereof in correspondence with a rotation of the hinge during both opening and closing of the door.

Advantageously, a rotation of a circular shaped element, for example a disk, inside the damping device of the hinge of the invention even during the door opening phase entails a displacement of the viscous means provided in the same device. This displacement makes it possible to eliminate the dissociation that is generally created between the molecules of the same viscous means. The better homogenization of said molecules guarantees a perfect operation of the damping device even after a period of long inactivity of the furniture hinge.

The improved efficiency of the hinge of the present invention is also obtained by increasing the friction surfaces with a viscous means present in suitable areas of the hinge and allowing regulation of the trend of the angular velocity of the disk, which acts as a braking element in contact with the viscous means.

Another advantage is represented by the fact that the damping device of the hinge of the invention forms a separate element which can be mounted, already assembled, with extreme ease on the base of a box element, or simply box, of standard type. In fact, as in the hinge of the invention the box element is separated from the damping device, it does not contribute towards the damping actions and can be produced with standard materials, for example simply by stamping, and does not require the use of more costly materials particularly suitable for damping.

From a production viewpoint all this implies that on a first production line it is possible to continue producing standard type hinges, while assembly of the damping device on said hinges, when required, is performed separately on a second independent line. Consequently, it is unnecessary to provide lines entirely dedicated to the production of hinges with integrated damping devices.

Moreover, while assembly of state of the art hinges provides for subsequent mounting on the box element of the elements forming the damping device one at a time, in the hinge of the invention said device, already assembled separately, is mounted on the base of the box of the hinge with a single, simple and quick operation. The box element therefore does not act as a supporting element during mounting of the elements of the damping device.

In an advantageous embodiment fixing of said device to the box is performed by means of the same two pins forming the articulation of the hinge rockers with the box, in the case of a hinge of articulated quadrilateral type, or by means of the single pin forming the articulation of the fixing arm with the box, in the case of a single pin hinge.

The standard box element is advantageously provided with an opening on the base thereof and has a shape suitable for quick assembly with the damping device. Moreover, in order to produce hinges provided with damping device it is sufficient for one of the two rockers or for the fixing arm directly to be provided on the first production line with a connection element capable of interacting, through the opening on the base of the box element, with the braking disk of the damping device. This connection element can, for example, be formed by one end of the same rocker or of the same fixing arm or by a separate element however connected to the rocker or to the fixing arm, or inserted thereon and pivoting about the respective pin.

Finally, a further advantage is that said damping device, thanks to its compactness and being mounted on the base of the box element, is incorporated inside the thickness of the furniture door and is therefore invisible when the door is opened, also improving the aesthetic appearance.

The dependent claims describe preferred embodiments of the invention.

BRIEF DESCRIPTION OF THE FIGURES

Further characteristics and advantages of the invention will be further evident in view of the detailed description of preferred, though not exclusive, embodiments of a furniture hinge with damping device, illustrated by way of non limiting example with the aid of the appended drawings wherein.

DETAILED DESCRIPTION OF PREFERRED EMBODIMENTS OF THE INVENTION

Figure 1A:
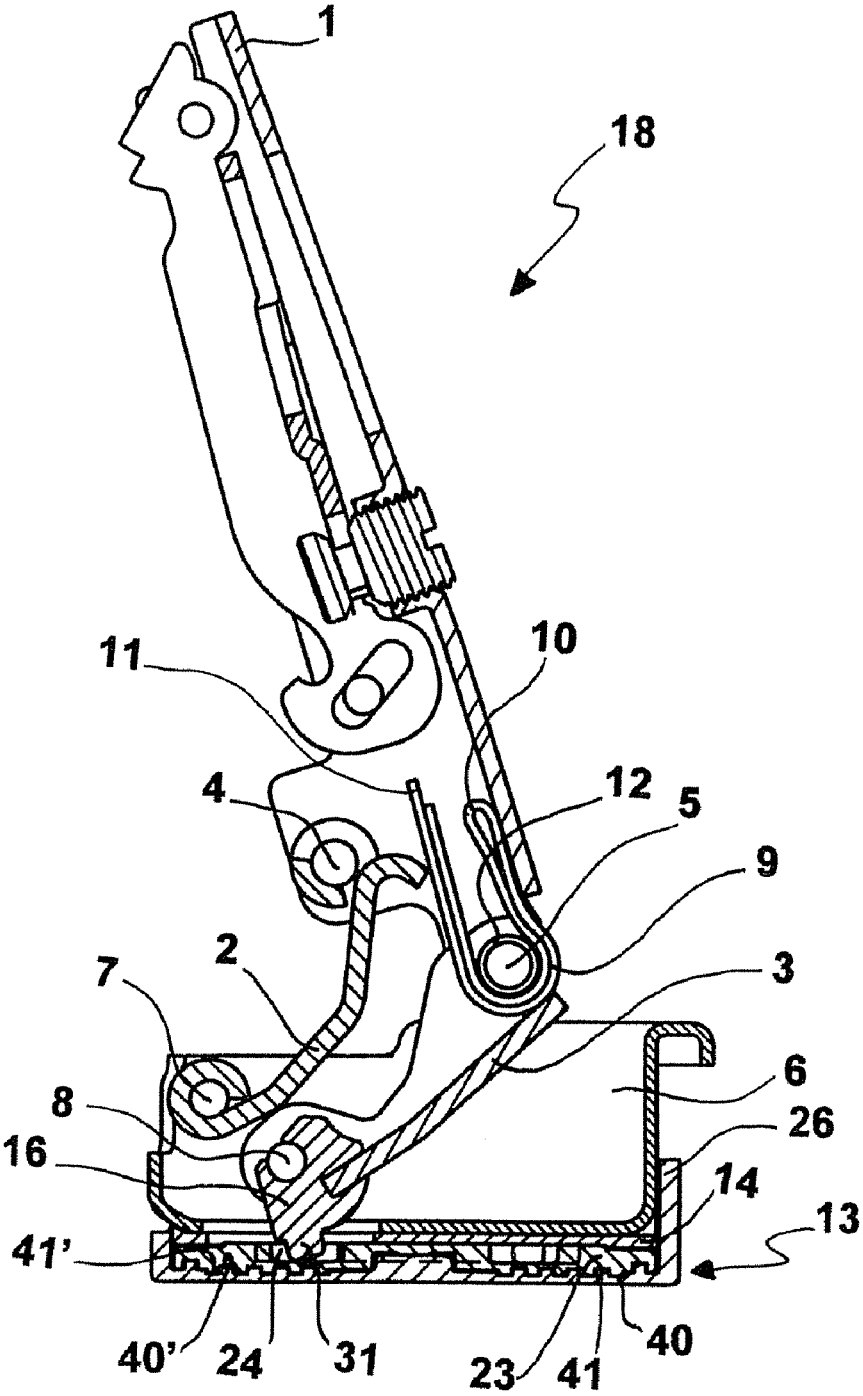
FIG. 1*a* shows a sectional view in a semi-open position of the hinge according to the invention.

With reference to FIG. 1*a*, a hinge is represented, indicated as a whole with the reference 18, comprising a fixed element, or hinge arm 1, which is fixable on a base, or plate, in turn fixed integrally to a bearing wall of a side panel or any suitable element of a piece of furniture. The hinge is provided with two rockers 2 and 3, with a respective first end thereof pivoting about two respective pins 4, 5 housed in holes in the side walls of the arm 1. The arm 1 is connected to a box element 6, fixed in a cavity produced in the inside wall of the door or wing of the piece of furniture, or of any other appropriate pivoting element of the piece of furniture. The two respective second ends of the rockers 2 and 3 are housed in rotation on other two respective pins 7, 8 with axes parallel to the first two pins 4, 5. The four pins 4, 5, 7, 8 form a articulated quadrilateral.

Around the articulation pin 5, connecting the rocker 3 to the arm 1, there is provided an elastic element or spring 9. One of the arms 10 of said elastic element is resting on the hinge arm 1, while the other arm 11 reacts on the rocker 2.

Closing of the arms 10, 11 of the elastic element 9 is established so that this element exerts a pushing force on the rocker 2 until the position shown in the same FIG. 1. Beyond this opening angle of the door, approximately from 15 to 20°, the elastic element 9 has a compression with a negligible application arm, so that the remaining part of the pivoting movement of the door takes place freely without being influenced by the presence of elastic forces.

On the other hand, in the closing phase of the door, the elastic element produces a return force in the closing direction which allows a precise and spontaneous closing of the door in the final angular space, with an amplitude of approximately 15 to 20°.

A bushing 12 can be appropriately interposed between the elastic element 9 and the pin 5. Alternatively, the element 9 can be detached from the pin 5 and be anchored in a known way to the hinge arm 1.

On the base of the box element 6 there is mounted advantageously a damping and/or braking device 13 suitable to reduce releases which take place during the opening and/or closing phases of the doors, reducing noise and allowing these phases to take place comfortably and smoothly.

Figure 2:
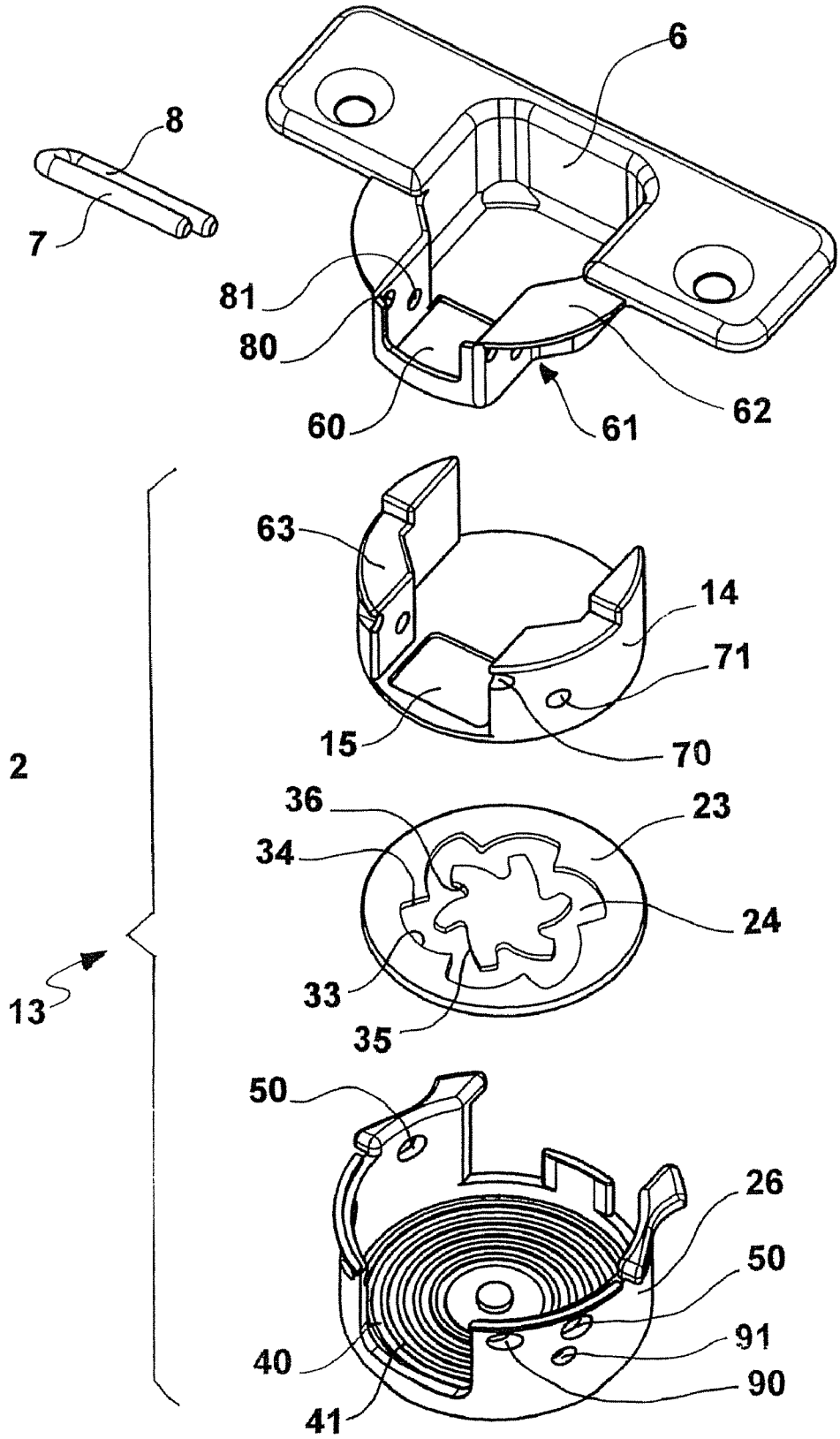
FIG. 2 shows an exploded view of a component of the hinge in FIG. 1.

This device 13 comprises, as illustrated in FIG. 2, a housing formed of an appropriately shaped casing 14 to allow fixing thereof to the box element 6, and of a bottom or base 26.

Inside said housing a braking disk 23 is inserted, with a substantially flat shape, immersed in a highly viscous means, for example grease.

Advantageously assembly of damping device 13 and box element 6 can also take place by means of the same pins 7, 8, about which the second ends of the rockers 2 and 3 respectively pivot, said pins passing through the corresponding holes 70, 71 of the casing 14, the holes 90, 91 of the bottom 26 and the holes 80, 81 of the box element 6.

The base of the casing 14 is provided with a hole or opening 15, substantially rectangular or square, to allow a cam connection element 16, fixed to the lower end of the rocker 3 pivoting around the pin 8 for articulation with the box element or being an integral part of said rocker, to engage by means of a tappet element 31, produced directly on the connection element 16, in a corresponding closed, flat figure shaped groove 24, for example a circuit, in turn produced on the surface of the braking disk 23.

The configuration of these hinge components is such that the tappet element 31, for example a pin with a substantially cylindrical shape, engages in the groove 24 in the last stretch of door closing movement. The closed, flat figure shaped groove 24 is provided, on its internal and external edges, with first stretches 33, 35 with a substantially spiral shape and second stretches 34, 36 substantially radial with respect to the center of the disk 23. The stretches 33 and 34 and the stretches 35 and 36 cyclically follow one another respectively on the external and internal edge of the groove where they are joined together such as to divide the disk 23 into a number of equal circular sectors.

In the example illustrated in the figures, there are six of these sectors and they have an angular amplitude equal to 60°, corresponding to the rotation performed by the disk 23 during each door opening/closing cycle.

The number of these sectors may also be different, thus making it possible to obtain different disk rotation angles with more or less steep slopes of the stretches 33, 35 with a spiral shape of the closed, flat figure shaped groove 24.

Figure 3A:
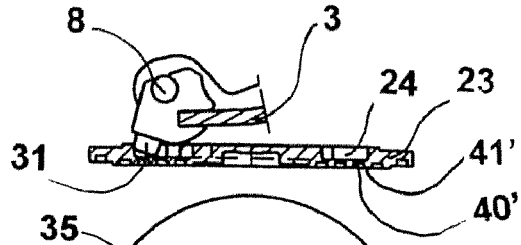
FIGS. 3*a*, 4*a*, 5*a* respectively show a sectional view of a detail of the hinge of FIG. 1 in three different positions.

FIG. 3*a* shows a sectional view of the disk 23 and part of the rocker 3, comprising the connection element 16, corresponding to the closed position of the hinge. It should be observed how the tappet element or projection 31 is engaged in the groove 24.

Figure 3B:
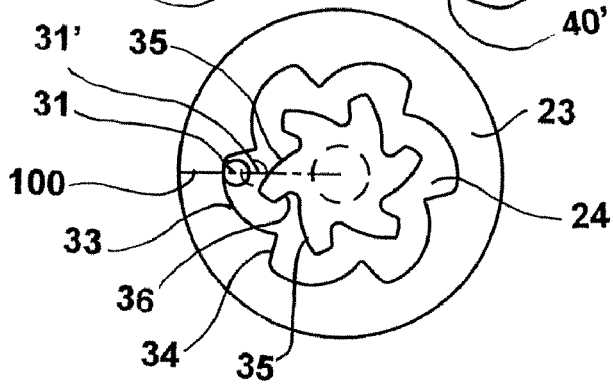
FIGS. 3*b*, 4*b*, 5*b* show plan views of the inside of a detail of the hinge corresponding respectively to the three positions in FIGS. 3*a*, 4*a*, 5*a*.

FIG. 3*b* shows a plan view of the disk 23 with the tappet element 31 in a position corresponding to the closing position of FIG. 3*a*. The tappet element 31 can only move horizontally along the dotted line 100 in relation to the oscillation of the rocker 3. Along this direction, as evident in FIG. 3*b*, the internal and external edges of the groove 24 present in such a way that a radial stretch 34 of the external edge substantially corresponds to a spiral stretch 35 of the internal edge and vice versa.

By effect of a door opening movement, the tappet element 31 shifts horizontally along the dotted line 100, i.e. along the width of the groove 24, to reach the dotted position 31', without the braking disk 23 being displaced. Continuing the door opening movement, the tappet element in position 31' exerts a pressure against the internal spiral stretch 35, thus entailing a rotation of the disk 23 around its center in an anti-clockwise direction to reach the configuration illustrated in FIGS. 4*a* and 4*b*. Beyond the position of the tappet element 31 in such figures, said element comes out of the groove 24 to follow the rocker 3 in the remaining part of the door opening movement.

The effect observed on the hinge during door opening is that after a first angular amplitude, in which it is only necessary to win the force of the spring 9 present in the hinge, in order to continue the opening movement it is necessary to win the strength of the damping device.

Advantageously, during this second opening phase the disk 23 is forced to rotate in such a way that the high viscosity grease, or other suitable viscous means, inside the damping device is suitably "moved". This phenomenon implies a mixing of the grease molecules able to eliminate their dissociation, created in particular in the case of a long inactivity of the hinge and therefore of the damping device, thus amalgamating again the molecules and recovering the cohesion force thereof. This allows the high viscosity grease to recover its homogeneity and, consequently, the damping device 13 exerts its function with the utmost efficiency in view of the subsequent hinge closing movement.

Figure 4A:
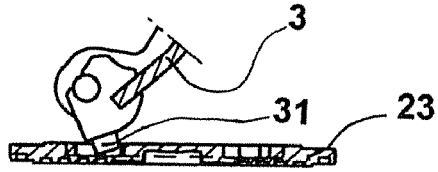
Figure 4B:
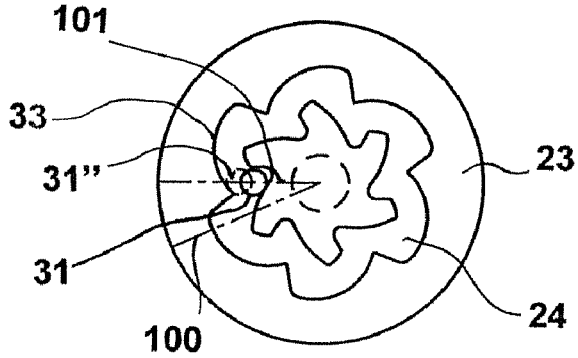
Figure 5A:
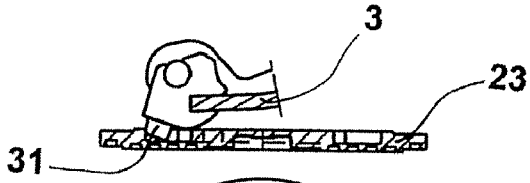
Figure 5B:
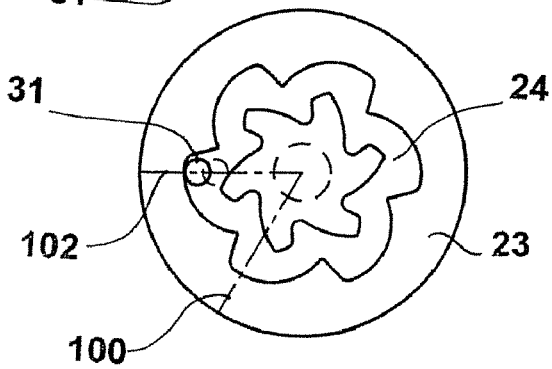

During the hinge closing movement, the tappet element 31 returns to the groove 24 in the position indicated in FIG. 4*b* and, after a brief displacement along the dotted line 101 until reaching position 31", it collides and exerts a pressure against the external spiral stretch 33 making the disk 23 rotate again in an anti-clockwise direction until reaching the configuration illustrated in FIGS. 5*a* and 5*b*. In FIG. 5*b*, it can be seen how the tappet element 31 is in a position equivalent to that one illustrated in FIG. 3*b* but arranged along a dotted line 102. The angular amplitude between dotted lines 100 and 102 corresponds to the angular amplitude of one of the sectors of the braking disk 23 and is the amplitude corresponding to the rotation of said disk during a door opening/closing cycle.

In particular, the angular amplitude of the rotation of the disk corresponding to the opening phase may be equal to the amplitude of the rotation corresponding to the closing phase, i.e. equal to the angular semi-amplitude of one of the sectors of the braking disk 23.

An advantageous expedient is to provide slots or holes 50 in the side walls of the bottom 26, in addition to the holes 90, 91 already provided for the pins 7 and 8 to pass through. Said holes 50 are suitable to couple corresponding projections, not shown in the figures, provided on the box element 6 in order to allow the damping device, already assembled, to be easily pre-mounted on the hinge.

Figure 1B:
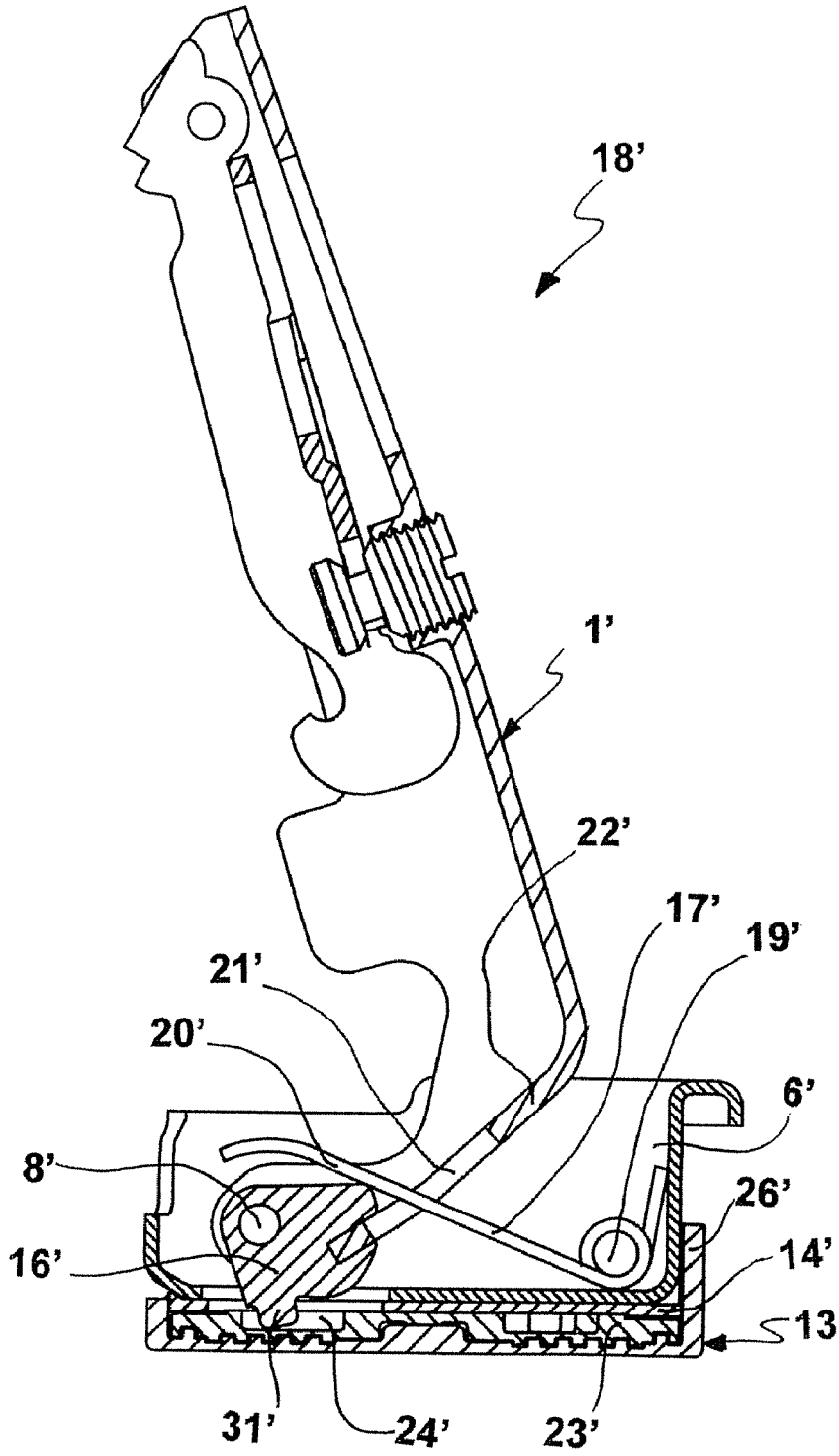
FIG. 1*b* shows a sectional view in a semi-open position of one embodiment of the hinge according to the invention.

A second embodiment of the invention provides for the application of the same damping device 13 to a hinge 18' with a single articulation pin 8', illustrated in FIG. 1*b*.

Unlike the articulated quadrilateral type hinge 18 described above, in single pin hinges there is provided a substantially L-shaped fixing arm 1', comprising the arm 1 and the rocker 3 of the hinge 18 in a single block, and suitable to pivot around the pin 8' of articulation with the box element 6'. As is known, there are not provided the rockers 2 and 3 and the other three articulation pins 4, 7, 5. FIG. 1*b* illustrates a torsion spring 17' wrapped around a further transverse pin 19' and fitted with an arm 20' that rests on an edge of the same connection element 16', acting as a cam, in order to provide the hinge with the closing thrust. More suitably, a pair of specular adjacent springs 17' can be provided, whose central arms 20' go through a central cavity 21' located in the bent part 22' of the fixing arm 1' of the hinge 18'.

Considering this second embodiment of the hinge, in FIGS. 3*a*, 4*a* and 5*a*, the element indicated with reference 3 therefore represents a stretch or end of the L of the fixing arm 1'.

In this second embodiment, the cam-type connection element 16' fixed to the end or bent part 22' of the fixing arm 1' or forming an integral part of said end, engages by means of the tappet element 31', produced directly on the connection element 16', in the corresponding closed, flat figure shaped groove 24', in turn produced on the surface of the braking disk 23' immersed in a highly viscous means.

Similarly to that illustrated in FIG. 2, also in this second embodiment slots or holes can be provided in the side walls of the bottom 26', in addition to the holes provided respectively on the casing 14', on the same bottom 26' and on the box element 6' for the passage of the pin 8' which guarantees a rapid fixing of the damping device 13 to the box element. Therefore, with both embodiments of the invention hinge, even during the first closing movement after a long period of inactivity, the high viscosity grease, thanks to its prior homogenization obtained during opening, allows the damping device to exert its braking function in an optimal way without the drawbacks encountered with state of the art devices. Advantageously, the facing surfaces of the braking disk and of the bottom or base, between which also here a viscous medium is disposed, comprise in both the embodiments a series of complementary concentric annular grooves 40', 40 and ribs 41', 41, which can be coupled as shown in FIG. 1. The flat part of the crests of the ribs and the bottom of the grooves can, moreover, be produced with a rough finishing to promote adhesion of the viscous medium, for example high viscosity grease, in contact with them. Advantageously, this expedient makes it more difficult for the grease to move in a radial direction, so that the use of gaskets between the bottom and the box element of the hinge is unnecessary.

Besides eliminating possible shortcomings in the operation of the damping device, a further advantage of the hinge of the invention is that it makes the device unquestionably silent and the braking force more incisive thanks to the increased extension of the coupled and friction surfaces with the viscous means. It is possible in fact to obtain the same braking effect obtained with the known devices using a smaller quantity of grease, or alternatively to obtain with the same quantity of grease a greater braking effect.

Advantageously, in both embodiments of the hinge the box element is provided with:

- an opening 60 on the bottom or lower surface thereof to allow interaction of the connection element 16, 16' with the braking disk 23, 23';
- and notches or indentations 61 on the side surface thereof which together with shelves 62, provided on the upper surface thereof and substantially having a shape of circular crown portion, define a space suitable to house corresponding projections 63 of the casings 14, 14'.

Optionally, the functions of the connections element can be obtained by means of an appropriate shape of tabs produced on the same plate forming the rocker 3 or the fixing arm 1' of the single pin hinge.

Furthermore, the hinge of the invention allows an efficient functioning without any variations to the overall dimensions of standard hinges.

Advantageously, the production costs of the hinge of the invention are considerably low; in fact the hinge here described have a great advantage from the structural viewpoint, namely that it comprises a damping device which forms a separate body and can therefore be mounted, already assembled separately, on the box element.

The box element can be of the type normally used to produce standard hinges, for example produced simply by stamping and provided in some cases with projections of reference which do not prevent conventional use of the hinge without any damping and/or braking device. This device, already assembled, can be combined with the box element chosen in the final assembly phase of the hinge, said pins 7, 8 or the only pin 8' being advantageously the essential elements used for fixing thereof. Therefore, it is possible to produce the hinge of the invention provided with damping device without having to provide for particular operations with respect to assembly of standard hinges. In fact, only a single fixing operation is required to hold together the box element of the hinge and the damping device. Moreover, the latter has the advantage of disappearing entirely inside the thickness of the door and of being invisible from the outside.

The specific embodiments described herein do not limit the content of this application, which covers all the embodiments of the invention defined by the claims.

The invention claimed is:

1. Furniture hinge comprising:

a fixing arm (1) for fixing to an element of a piece of furniture, a fixing structure for fixing to a door of said element of said piece of furniture, comprising a box (6), first (3) and second (2) rockers, each suitable to pivot around a respective first articulation pin (8, 7) with said box (6) and around a respective second articulation pin (5, 4) with said fixing arm (1) forming an articulated quadrilateral and joining said fixing arm (1) to said box (6) allowing reciprocal pivoting thereof, a connection element (16) for connecting, using at least one tappet element (31) provided on said connection element, said fixing arm (1) to damping device (13) for damping said reciprocal pivoting, said damping device being immersed in a viscous material, wherein said damping device includes only one substantially flat disk (23), provided on a first face with a groove (24) having a shape of a closed flat figure forming a circuit around the center of the disk and wherein said connection element (16) is fixed to the first rocker (3) and said at least one tappet element (31) engages said groove (24) to convert the pivoting motion of the first rocker (3) in a rotation motion of said disk (23) around the center thereof and always in the same direction in correspondence with a rotation of the hinge during both opening and closing of the door.

2. Hinge according to claim 1, wherein said tappet element (31) comprises a substantially cylindrical shaped pin.

3. Hinge according to claim 2, wherein said closed flat figure comprises first stretches (33, 35) of a substantially spiral shape and second stretches (34, 36) substantially radial with respect to the center of the disk (23).

4. Hinge according to claim 3, wherein said first stretches (33, 35) and second stretches (34, 36) follow one another cyclically on the external edge and on the internal edge of said closed flat figure and are joined together in such a way as to subdivide the disk into equal circular sectors.

5. Hinge according to claim 4, wherein said pin (31) engages said groove (24) having the shape of a closed flat figure during at least a part of the pivoting motion of the first member.

6. Hinge according to claim 5, wherein said damping device (13) comprises a housing separated from said box (6), in turn comprising a casing (14) and a bottom (26) enclosing said disk (23), and including fast connection elements (7, 8, 50) wherein said disk is assembled with the housing in such a way that said damping device forms a single element fixed to one end of said box (6) in a single mounting operation.

7. Hinge according to claim 6, wherein said fast connection elements comprise the articulation pins (7, 8), engaging first holes (70, 71, 90, 91) of the housing (14, 26) and second holes (80, 81) of the box (6), and optional slots (50) for a pre-mounting operation.

8. Hinge according to claim 7, wherein there are provided on the bottom (26) ribs (41) and grooves (40) complementary to corresponding grooves (40') and ribs (41') provided on a second face of the disk (23).

9. Furniture hinge comprising a first member (1') for fixing to an element of a piece of furniture, a second member for fixing to a door of said element of said piece of furniture, comprising a box (6'), said first member moving with a pivoting motion around an articulation pin (8') with said box (6'), a connection element (16') for connecting, using at least one tappet element (31') provided on said connection element, said first member to damping device (13) for damping said pivoting motion, said damping device being immersed in a viscous material, wherein said damping device includes only one substantially flat disk (23'), provided on a first face with a groove (24') having a shape of a closed flat figure forming a circuit around the center of the disk and wherein said connection element (16') is fixed to the first member (1') of the hinge and said at least one tappet element (31') engages said groove (24') to convert the pivoting motion of the first member in a rotation motion of said disk (23') around the center thereof and always in a same direction in correspondence with a rotation of the hinge during both opening and closing of the door.

10. Hinge according to claim 9, wherein said tappet element (31') comprises a substantially cylindrical shaped pin.

11. Hinge according to claim 10, wherein said closed flat figure comprises first stretches (33, 35) of a substantially spiral shape and second stretches (34, 36) substantially radial with respect to the center of the disk (23').

12. Hinge according to claim 11, wherein said first stretches (33, 35) and second stretches (34, 36) follow one another cyclically on the external edge and on the internal edge of said closed flat figure and are joined together in such a way as to subdivide the disk into equal circular sectors.

13. Hinge according to claim 12, wherein said pin (31') engages said groove (24') having a shape of closed flat figure during at least a part of the pivoting motion of the first member.

14. Hinge according to claim 13, wherein said damping device (13) comprises a housing separated from said box (6'), in turn comprising a casing (14') and a bottom (26') enclosing said disk (23'), and include fast connection elements (8', 50) wherein said disk is assembled with the housing in such a way that said damping device forms a single element fixed to one end of said box (6') in a single mounting operation.

15. Hinge according to claim 14, wherein said fast connection element comprises the articulation pin (8') engaging first holes of the housing (14, 26) and second holes of the box (6') and optional slots for a pre-mounting operation.

16. Hinge according to claim 15, wherein there are provided on the bottom (26') ribs (41) and grooves (40) complementary to corresponding grooves (40') and ribs (41') provided on a second face of the disk (23').

* * * * *